US005669463A

United States Patent [19]

Robertson

[11] Patent Number: 5,669,463

[45] Date of Patent: Sep. 23, 1997

[54] TRUCK MECHANIC'S WORKSTAND

[75] Inventor: Dale A. Robertson, Sedro Wooley, Wash.

[73] Assignee: PACCAR Inc., Bellevue, Wash.

[21] Appl. No.: 542,948

[22] Filed: Oct. 13, 1995

[51] Int. Cl.[6] ..... E06C 7/16

[52] U.S. Cl. ..... 182/116; 182/115; 182/132

[58] Field of Search ..... 182/17, 115, 116, 182/132

[56] References Cited

U.S. PATENT DOCUMENTS

| | | | |
|---|---|---|---|
| 2,701,168 | 2/1955 | Schemers | 304/9 |
| 2,851,312 | 9/1958 | Hoff | 304/15 |
| 2,872,252 | 2/1959 | Konkle | 182/132 X |
| 2,957,541 | 10/1960 | Everest et al. | 182/115 |
| 2,970,668 | 2/1961 | Snyder | 182/116 |
| 3,446,310 | 5/1969 | Alfie | 182/156 |
| 3,446,311 | 5/1969 | Alfie | 182/156 |
| 3,590,950 | 7/1971 | Wilson | 182/150 |
| 3,870,333 | 3/1975 | Burdick et al. | 182/132 X |
| 4,072,209 | 2/1978 | Bolis | 182/116 |
| 4,542,806 | 9/1985 | Olson | 182/116 X |
| 4,618,029 | 10/1986 | Lowry | 182/116 |
| 4,800,987 | 1/1989 | Liles | 182/92 |
| 4,919,229 | 4/1990 | Wells | 182/17 |
| 4,947,961 | 8/1990 | Dudley | 182/92 |
| 5,072,955 | 12/1991 | Holland et al. | 182/116 X |
| 5,133,429 | 7/1992 | Densley | 182/50 |
| 5,370,204 | 12/1994 | Fox | 182/116 X |

*Primary Examiner*—Leslie A. Braun
*Assistant Examiner*—Richard M. Smith
*Attorney, Agent, or Firm*—Seed and Berry LLP

[57] ABSTRACT

A workstand for use when servicing heavy tracks or the like, the workstand including opposing curved first and second sides spaced apart from each other and a top support platform extending therebetween. Upper and lower steps extend between the front portions of the curved first and second sides to provide access to the top support platform. The curved first and second sides combine with the top support platform and the steps form a structure having a wheel receiving area therein and having an open backside that provides access to the wheel receiving area. The workstand is constructed to be positioned around a tire of the truck's wheel assembly with the first and second sides immediately adjacent to the frame of the vehicle and the top support platform above the wheel receiving area so as to support a mechanic or the like above the wheel assembly adjacent to the vehicle's engine.

23 Claims, 2 Drawing Sheets

TRUCK MECHANIC'S WORKSTAND

TECHNICAL FIELD

The present invention is directed toward a workstand, and more particularly, to a workstand used by a truck mechanic during manufacture or maintenance of a truck or other similar vehicle.

BACKGROUND OF THE INVENTION

Several conventional devices are available to assist mechanics working on automobiles or other vehicles, which allow the mechanic to maintain an advantageous position relative to the vehicle. These devices include several types of dollies on which a mechanic lies to allow the mechanic to roll along the ground under the vehicle. Other conventional devices include extended platforms, such as those disclosed in U.S. Pat. Nos. 2,701,168; 2,970,668; and 4,072,209, which allow a mechanic to lie on a platform that extends over the vehicle's engine compartment. These extended platforms are best suited for servicing automobiles with engines enclosed in the body of the vehicle, below the line of the fenders. The extended platform devices are typically not suitable for servicing heavy trucks, because a heavy truck's engine is generally located above the truck's frame rails and is largely exposed when the truck's hood or cab is tilted. Accordingly, a mechanic does not need to be supported in a prone position over the top of the engine, as is often necessary when working on an automobile.

Other conventional devices designed to assist mechanics include hanging steps that removably attach directly to the tire of a vehicle, such that the steps are along the outside of the tire. Such devices are disclosed in U.S. Pat. Nos. 2,851,312; 3,590,950; 4,800,987; 4,947,961; and 5,133,429. These tire-mounted steps provide an elevated support surface which enables the mechanic to lie over the fender of an automobile and lean into the engine compartment of the vehicle. However, the fire-mounted steps are of little utility to a mechanic working on a heavy truck, since there is no fender or body to lie upon once the hood or cab of the truck is tilted and the engine is exposed. Further, because of the width of the heavy truck's fires, the distance from the outside of the tire to the engine compartment is typically beyond, or at the end of, a mechanic's reach. Accordingly, the tire-mounted steps do not provide adequate assistance to a mechanic during a manufacture or maintenance procedure on a heavy truck.

The engine of a heavy track is positioned above the front axle and between the front wheels, and when the hood on a conventional model mack or the cab of a cab-over-engine model is tilted, the engine is largely exposed for servicing. Were it not for the front axle and tires, most components in the engine compartment would be readily accessible to a mechanic, except for components on the top portion of the engine. As a result, a mechanic will often stand on the axle, the frame, or on top of the mack's tire to gain full access to the engine. However, the axle, frame, and tires are not designed with specific foot supports to assist a mechanic in gaining access to components in the engine compartment.

Conventional stepladders such as those disclosed in U.S. Pat. Nos. 3,446,310 and 3,446,311 are also of little use to a mechanic while servicing a heavy mack's engine because the mack's tires block the stepladder from being placed adjacent to the mack frame. Accordingly, the stepladder must be placed along the outside of the tire, and the distance from the outside of the tire to the engine compartment is beyond, or at the end of, a mechanic's reach.

SUMMARY OF THE INVENTION

The present invention provides a workstand that is positionable around a vehicle's wheel assembly to allow a person to be supported above a vehicle's tire and to maintain an advantageous body position relative to the vehicle while servicing the vehicle. In one embodiment, the workstand includes left and right sides and a top support platform extending between top portions of the left and right sides. The left and right sides are spaced apart from each other and define a wheel receiving area therebetween and the top support platform defines a top of the wheel receiving area. The workstand has an open back side that provides direct access to the wheel receiving area, and the wheel receiving area is shaped and sized to receive the wheel assembly of a vehicle through the open back side. The workstand is positionable so the left and right sides are adjacent to the vehicle's frame with the wheel assembly between the left and right sides and below the top support platform. A step extends between the front portions of the left and right sides opposite the open back side and below the top support platform. The step is positioned to provide convenient and easy access to the top support platform.

In a preferred embodiment of the invention, each of the left and right sides includes inboard and outboard legs with crossmembers extending therebetween to provide a secure and stable structure. The left and right sides each have a plurality of segments interconnected at angles relative to each other to define a shape that generally corresponds to the curvature of the tire of the wheel assembly. The segmented left and right sides allow the workstand to fit closely over and around the wheel assembly. Two or more steps extend between the left and right sides below the top support member to provide convenient access to the top support platform. Wheels are attached to the bottom of the workstand, such that the workstand is easily relocatable to and from the heavy vehicle.

Accordingly, the workstand of the present invention provides an open back structure positionable over the vehicle's wheel assembly to provide a stable and secure platform above the top of the wheel assembly that will support a person servicing the engine or other components of the vehicle. The present invention also provides a method of supporting a person adjacent to the engine of a vehicle. The method includes moving the workstand to the vehicle, positioning the workstand adjacent to the vehicle and around a wheel assembly of the vehicle with the wheel assembly located within the wheel receiving area, and supporting the person on the top support member of the workstand above the wheel assembly and adjacent to the engine of the vehicle.

DETAILED DESCRIPTION OF THE INVENTION

Figure 1:
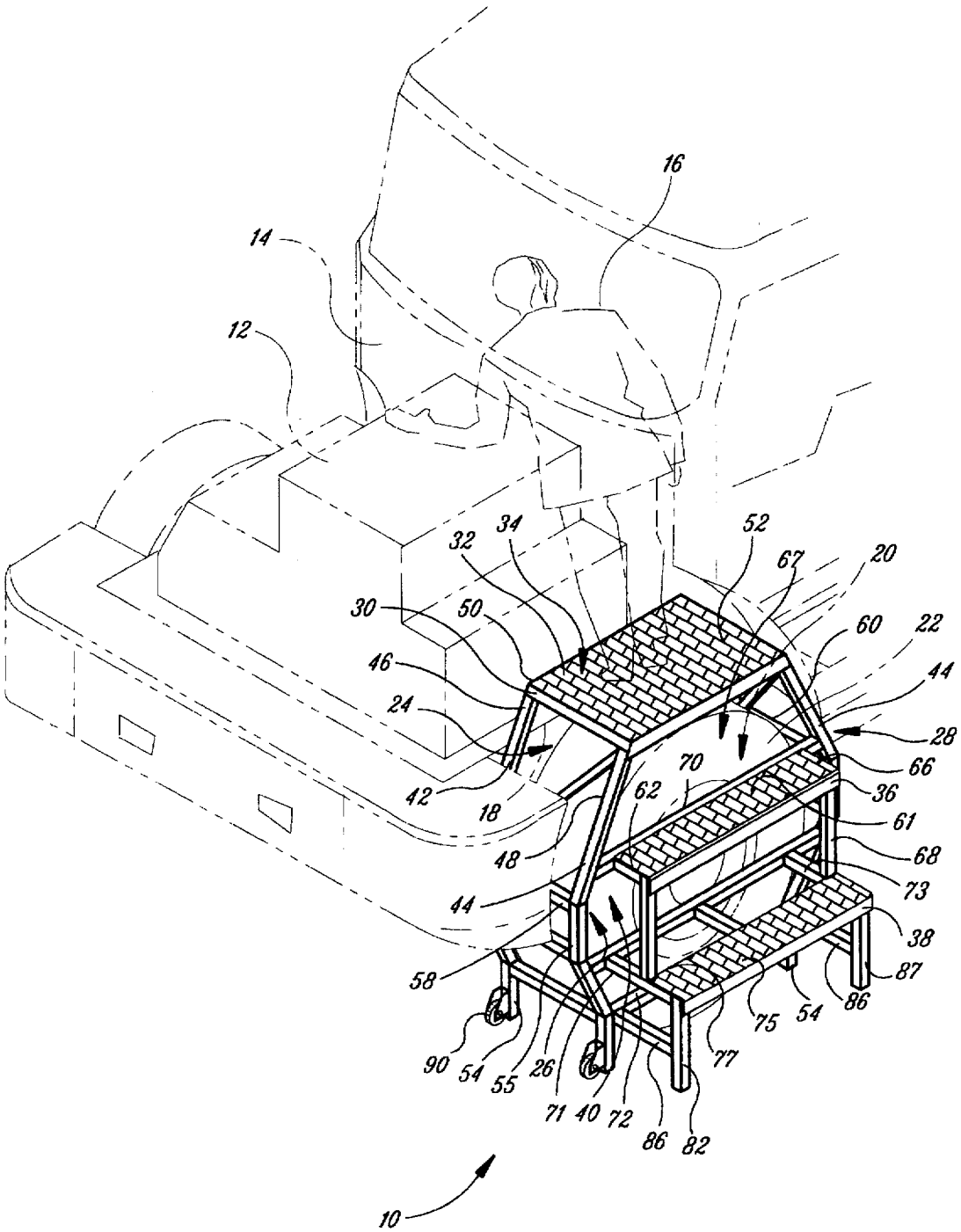
FIG. 1 is an isometric view of a workstand in accordance with the present invention, the workstand being shown adjacent to a heavy truck, illustrated in phantom lines, with a wheel assembly of the track positioned within a wheel receiving area of the workstand.

A workstand 10 in accordance with the present invention is illustrated in FIG. 1 adjacent to an exposed engine 12 of a heavy truck 14 shown in phantom lines. The workstand 10 is constructed to be positioned around the wheel assembly 20 and adjacent to a frame rail 18 so as to support a mechanic 16 in an elevated and advantageous position adjacent to the engine 12 for servicing the track 14. The truck 14 of the illustrated embodiment has the engine 12 mounted to frame rails 18 at the front of the truck in a location where the engine is generally exposed when a hood or cab of the heavy truck is tilted to an open position. The truck 14 also includes conventional wheel assemblies 20 that include or are adapted to include a tire 22 outwardly adjacent to the frame rails 18 and the engine 12.

The workstand 10 includes left and fight sides 26 and 28, and a top support platform 34 extending between the left and right sides. The top support platform 34 is positioned at approximately the same height as the top of the frame rail 18. Upper and lower steps 36 and 38 extend between the left and right sides 26 and 28, and the steps are positioned below the top support platform 34 to provide convenient and easy access to the top support platform 34. The workstand 10 has an open inboard side 24 opposite the upper and lower steps 36 and 38, and the open inboard side provides substantially unobstructed access to a wheel receiving area 40 between the left and right sides 26 and 28 and below the top support platform 34. The wheel receiving area 40 removably receives the wheel assembly 20 through the open inboard side 24 when the workstand 10 is moved to a working position, as is illustrated in FIG. 1.

In the working position, the left and right sides 26 and 28 of the workstand 10 are immediately adjacent to the frame rail 18 and the top support platform 34 is above the wheel assembly 20. Accordingly, the workstand 10 supports the mechanic 16 above the wheel assembly 20 and enables the mechanic to maintain an advantageous elevated position in order to access the top of the engine 12. In the preferred embodiment, the top support platform 34 is constructed of an outer frame 30 that supports a step grate 32, which provides a non-slip top surface. The step grate 32 is sized to allow the mechanic to stand, kneel, or sit on the top support platform and to temporarily store thereon tools or the like used in servicing the truck 14.

Each of the left and right sides 26 and 28 of the workstand 10 includes inboard and outboard legs 42 and 44 that are securely connected at their respective top portions 46 and 48 to the outer frame 30 top support platform 34. When the workstand 10 is in the working position, the inboard legs 42 are positioned immediately adjacent to the frame rail 18 on opposite sides of the wheel assembly 20, and the outboard legs 44 are located outwardly away from the frame rail and adjacent to the outboard side of the tire 22.

Figure 2:
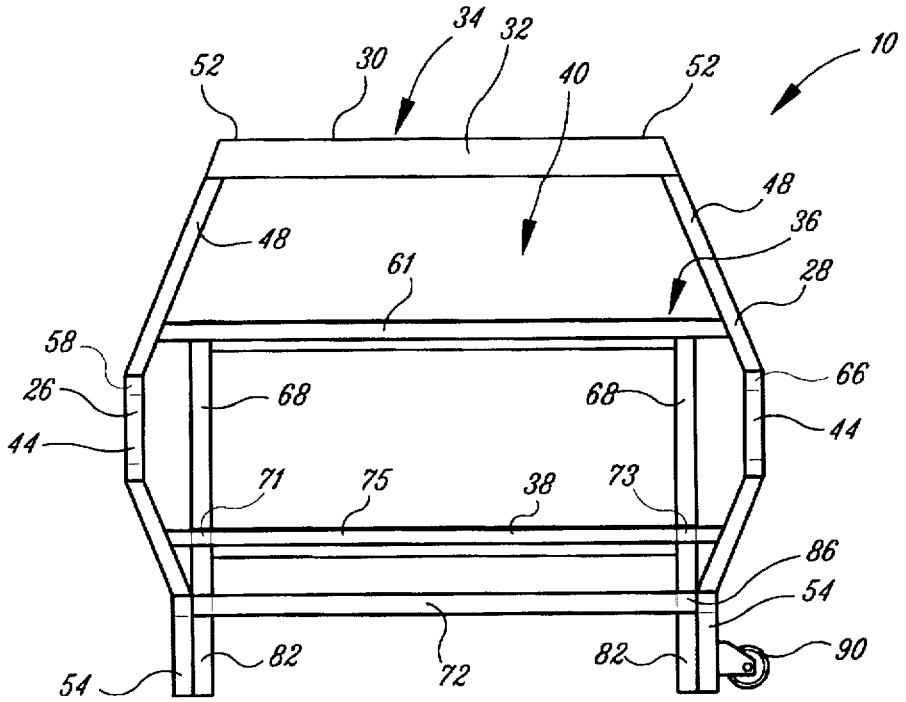
FIG. 2 is a rear elevation view of the workstand of FIG. 1.
Figure 3:
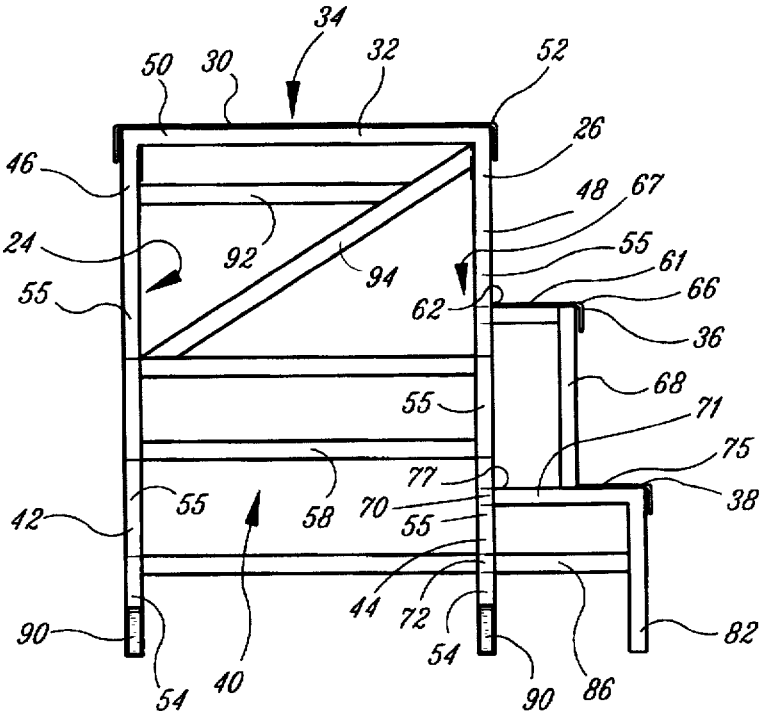
FIG. 3 is a left side elevation view of the workstand of FIG. 1.

As best seen in FIGS. 1–3, the top portions 46 of the inboard legs 42 are rigidly secured, by welding or the like, to inboard comers 50 of the top support platform 34, and the top portions 48 of the outboard legs 44 are rigidly connected to outboard comers 52 of the top support platform. The inboard and outboard legs 42 and 44 extend downwardly from the top support platform 34, and bottom portions 54 of the inboard and outboard legs rest on the ground to provide a stable structure.

Each of the inboard and outboard legs 42 and 44 have several sections 55 that are connected together at angles relative to each other to define a contoured leg such that the left and right sides 26 and 28 have a shape generally corresponding to the outer of the tire 22 of the wheel assembly 20. The shape of the inboard and outboard legs 42 and 44 allows the workstand 10 to fit closely around the outside of the tire 22 when the workstand is in the working position. The inboard and outboard legs 42 and 44 also allow the workstand 10 to be closely positioned over and around the tire 22 within the fore and aft space around the conventional wheel assembly 20.

The left side 26 of the workstand 10 includes a plurality of crossmembers 58 extending between the respective inboard and outboard legs 42 and 44. Similarly, the right side 28 has a plurality of crossmembers 60 extending between the respective inboard and outboard legs 42 and 44. The crossmembers 58 and 60 work in conjunction with the top support platform 34 and the upper and lower steps 36 and 38 to provide a structurally stable workstand. Upper and lower crossmembers 70 and 72 connect the outboard legs 44 of the left and right sides 26 and 28 such that the outboard legs and the upper and lower crossmembers define an outboard side 67 of the wheel receiving area 40 that is opposite the open inboard side 24.

The upper and lower crossmembers 70 and 72 extend horizontally between the outboard legs 44 and are welded or otherwise securely attached at their ends to the outboard legs. The lower crossmember 72 is attached to the outboard legs 44 above the bottom portions 54 of the outboard legs, and the upper crossmember is located between the lower crossmember 70 and the upper step 36. The upper and lower crossmembers 70 and 72 work in conjunction with the upper and lower steps 36 and 38 and the crossmembers 58 and 60 of the left and right sides 26 and 28, providing a substantially rigid connection between the inboard and outboard legs 42 and 44 of the left and fight sides 26 and 28.

The upper step 36 is a generally horizontal platform having inboard comers 62 that are welded to the outboard legs 42 above the upper crossmember 70. The upper step 36 includes a top step gate 61 that extends horizontally away from the wheel assembly 20 and provides a no-slip surface upon which a mechanic steps while ascending to or descending from the top support platform 34. The outboard comers 66 of the upper step 36 are above the lower step 38, and vertical support members 68 extend between the upper step's outboard comers and the lower step 38. The support members 68 extend downwardly from the lower step and are rigidly connected to the lower step 38.

The lower step 38 is welded to the upper crossmember 70 between the outboard legs 44 of the left and right sides 26 and 28. The lower step 38 has horizontal left and right supports 71 and 73 that are attached at their inboard ends to the upper crossmember 70, and that are substantially perpendicular to the upper crossmember. A bottom step grate 75 extends between the horizontal supports 71 and 73, with an inboard edge 77 of the step grate located below the outboard edge of the top step grate 61. The bottom step grate 75 provides a no-slip surface.

Support legs 82 are attached to the outboard comers of the lower step 38 and extend downwardly toward the floor. Horizontal crossmembers 86 interconnect the support legs 82, the lower crossmember 70, and the outboard legs 42, to provide a rigid support structure for the lower step 38, thereby providing a rigid support structure for the upper step 36.

Although the components of the preferred embodiment are welded together, the component can be securely interconnected, by fasteners, for example, or by other connection means, to provide a stable, solid workstand for supporting the mechanic.

As best seen in FIGS. 2 and 3, the workstand 10 of the illustrated embodiment has wheels 90 attached to the inboard and outboard legs 42 and 44 of the right side 28. The wheels 90 are located at a position slightly above the ground such that the wheels do not engage the ground when the inboard and outboard legs 42 and 44 are all resting on the ground. However, the wheels 90 are positioned to engage the ground when the left side 26 of the workstand 10 is tipped off of the ground, thereby allowing the workstand to be rolled to the track and then moved into the working position. As best seen in FIG. 3, a handle 92 extends between the inboard leg 42 of the right side 28 and a diagonal cross member 94 attached to the inboard and outboard legs 42 and 44. The handle 92 is positioned to allow the mechanic to grab it and tip the workstand 10 onto the wheels 90, such that the left side 25 is off of the ground.

In alternate embodiments not shown, the wheels 90 are attached to the inboard and outboard sides 92 and 44 of the left side 26, or to the inboard legs 42 of the left and right sides 26 or 28, such that the wheels will engage the ground when the opposite side of the workstand is lifted off of the ground, thereby tipping the workstand onto the wheels.

Referring again to FIG. 1, the mechanic 16 uses the workstand 10 by grasping the handle 92 and tipping the workstand onto the wheels 90, moving the workstand toward the track 14, and positioning the workstand adjacent to the track such that the truck's wheel assembly 20 is located within the wheel receiving area 40. In the embodiment that does not have the wheels, the workstand is carried or slid to the track and then moved into position over the wheel assembly 20 and adjacent to the truck 14. Accordingly, the inboard legs 42 of the left and right sides 26 and 28 are located immediately adjacent to the truck's frame rails 18, and the top support platform 34 is located above the wheel assembly 20 and generally adjacent to the engine 12. The mechanic tips the workstand so the inboard and outboard legs 42 and 44 are all securely resting on the ground, and in the wheeled embodiment the wheels 90 are lifted off of the ground. The support legs 82 connected to the lower step 38 also rest on the ground, so as to support the outboard side of the lower step.

When the workstand 10 is securely positioned on the ground and the wheel assembly 20 is within the wheel receiving area 40, the mechanic 16 climbs up the lower and upper steps 38 and 36 and onto the top support platform 34. The mechanic 16 is supported on the top support platform 34 above the tire 22 and the wheel assembly 20, and adjacent to the engine 12. Thereafter, the mechanic 16 performs one or more selected service operations on the engine 12 and/or other component of the truck 14. The mechanic 16 climbs off of the top support platform 34 of the workstand 10 by climbing down the upper and lower steps 36 and 38. The mechanic 16 then removes the workstand 10 from the working position by grasping the handle 92, tipping the workstand onto the wheels 90 and moving the workstand away from the track 14. In the embodiment not having wheels, the mechanic lifts or slides the workstand 10 away from the track 14.

While various embodiments of the mechanic's workstand in accordance with the present invention have been described for illustrative purposes, the claims are not limited to the embodiments described herein. Equivalent devices may be substituted for those described, which operate according to the principles of the present invention, and thus fall within the scope of the following claims. Therefore, it is to be expressly understood that the modifications and variations made to the mechanic's workstand of the present invention may be practiced while remaining with the spirit and the scope of the invention as defined in the following claims.

I claim:

1. A workstand for use with a vehicle having a wheel assembly, comprising:

first and second sides each having front and back portions, said first and second sides being spaced apart from each other and defining a wheel receiving area therebetween, said wheel receiving area having an open back between said back side portions, said first side including a first inner leg portion and a first outer leg portion separate and spaced apart from each other, and said second side including a second inner leg portion spaced apart from said first inner leg portion and a second outer leg portion separate and spaced apart from said second inner leg portion, each of said first and second inner and outer leg portions having top and bottom portions;

a top support platform extending between said first and second sides and being attached to said top portions of said first and second inner and outer leg portions, said top support platform defining a top of said wheel receiving area, said wheel receiving area being shaped and sized to receive the wheel assembly therein through said open back; and a step attached to said front portions of said first and second sides below said top support platform.

2. The workstand of claim 1 wherein the wheel assembly has a curvature and said first and second sides each comprise a plurality of segments interconnected to extend around a portion of the curvature of the wheel assembly.

3. The workstand of claim 1 wherein the wheel assembly has a curvature and said first and second sides each have a curved shape that extends around a portion of the armature of the wheel assembly.

4. The workstand of claim 1 wherein said step is a first step and said workstand further includes a second step below said first step.

5. The workstand of claim 1 wherein each of said first and second sides includes cross members extending between said first inner and outer leg portions and between said second inner and outer leg portions.

6. The workstand of claim 1 further comprising at least one wheel attached to said first side.

7. The workstand of claim 6 further comprising a handle attached to said first side.

8. A workstand for supporting a worker above a tire of a motor vehicle, the motor vehicle having a frame rail adjacent to the tire, comprising:

first and second sides spaced apart from each other a distance greater than the diameter of the tire, each of said first and second sides having front and back portions, said first and second sides having no obstructions between said back portions to define an open back side sized to receive the tire therebetween, said back portions of said first and second sides being positioned adjacent to the frame rail when the tire is between said first and second sides, said first side including first front and rear leg portions separate and spaced apart from each other, and said second side including second front and rear leg portions separate and spaced apart from each other, each of said first and second front and rear leg portions having top portions;

a top support platform extending between said top portions of first and second front and rear leg portions, said top support platform being at a height that is greater than the diameter of the tire and said top support platform being positioned above the tire and adjacent to the frame rail when the tire is between said first and second sides; and a step attached to said front portions of said first and second sides below said top support platform.

9. The workstand of claim 8 wherein the tire has a curved shape and each of said first and second sides has a plurality of segments interconnected at angles relative to each other to extend around a portion of the curved shape of the tire.

10. The workstand of claim 8 wherein the tire has a first curved shape and each of said first and second sides has a second curved shape to extend around a portion of the first curved shape of the tire.

11. The workstand of claim 8 wherein said step is a first step and said workstand further includes a second step below said first step.

12. The workstand of claim 8 further comprising at least one wheel attached to said first side, and a handle attached to said first side.

13. The workstand of claim 8 wherein each of said first and second sides includes cross members extending between said first front and rear portions and between said second front and rear leg portions.

14. A method of supporting a person adjacent to an engine of a motor vehicle, the vehicle having a frame, a wheel assembly adjacent to the frame and an engine coupled to the frame, the wheel assembly having a first side adjacent to and facing the frame and a second side facing away from the frame, comprising the steps:

moving a workstand toward the vehicle, the workstand comprising first and second sides each having a top portion and from and back portions, the front and back portions being separate and spaced apart from each other, the first and second sides being spaced apart from each other and defining a wheel receiving area therebetween, the wheel receiving area having an open back between the back side portions of the first and second sides, a top support platform attached to the top portions of the first and second sides and the top support platform extending between the first and second sides and defining a top of the wheel receiving area;

positioning the workstand adjacent to the vehicle with the wheel assembly in the wheel receiving area with the front portions of the first and second sides being positioned adjacent to the first side of the wheel assembly, and the rear portions of the first and second sides being positioned adjacent to the second side of the wheel assembly, and the top support platform being positioned above the wheel assembly and adjacent to the engine; and supporting the person on the top support platform above the wheel assembly and adjacent to the engine.

15. The method of claim 14 wherein the workstand includes wheels attached to said first side, and the step of moving the workstand toward the vehicle comprises rolling the workstand on the wheels toward the vehicle.

16. The method of claim 14 wherein the workstand includes a step attached to the front portions of the first and second sides below the top support platform, the method further comprising the step of temporarily supporting the person on the step before or after the person is supported on the top support platform.

17. A workstand for use with a motor vehicle having a wheel assembly, comprising:

left and right inner legs spaced apart from each other and each having first top and bottom portions, said first bottom position being adapted to engage the ground, said left and right inner legs having a plurality of segments at angles relative to each other to extend around a portion of the wheel assembly;

left and right outer legs outwardly adjacent to said left and right inner legs respectively, each of said left and right outer legs having second top and bottom portions, said second bottom portion being adapted to engage the ground;

outer support members extending between said left and right outer legs, left support members extending between said left inner and outer legs, and right support members extending between said right inner and outer legs, said outer, left, and right support members interconnecting said left and right inner legs and said left and right outer legs to define a wheel receiving area;

a top support platform attached to the top portions of the left and right, inner and outer legs, said platform extending over said wheel receiving area and providing a stable and secure platform adapted to support the weight of a person thereon;

a first step securely extending between said left and right outer legs, said first step being positioned below said top support platform; and support legs attached to said first step, said support legs being adapted to support said first step.

18. The workstand of claim 17, further comprising a second step securely attached to said left and right outer legs, said second step being positioned below and outward from said first step.

19. The workstand of claim 18 wherein said support legs extend between said first and second steps.

20. A workstand, comprising:

left and right inner legs spaced a selected distance apart from each other, said distance being selected to be greater than a diameter of a standard vehicle tire, each of said left and right inner legs having first top portions, said left and right inner legs having a plurality of segments at angles relative to each other to extend around a portion of the tire;

left and right outer legs outwardly adjacent to said left and right inner legs respectively, each of said left and right outer legs having second top portions;

support members interconnecting said left and right outer legs and said left and fight inner legs to define a tire receiving area;

a top support platform attached to said first and second top portions of the left and right inner legs and said left and right outer legs, said top support platform extending over said tire receiving area and providing a stable and secure platform adapted to support the weight of a person thereon, said top platform having an inside edge portion extending between the left and right inner legs;

a first step securely extending between said left and right outer legs, said first step being positioned below said top support platform; and support legs attached to said first step, said support legs being adapted to support said first step.

21. The workstand of claim 20 wherein said left and right outer legs are spaced apart a selected distance from said left and right inner legs, respectively, said distance being selected to be equal or greater than a width of the standard vehicle tire.

22. The workstand of claim 20, further comprising a second step securely attached to said left and right outer legs, said second step being positioned below and outward from said first step.

23. The workstand of claim 22 wherein said support legs extend between said first and second steps.

* * * * *

UNITED STATES PATENT AND TRADEMARK OFFICE

CERTIFICATE OF CORRECTION

PATENT NO. : 5,669,463

DATED : September 23, 1997

INVENTOR(S) : Dale A. Robertson

It is certified that error appears in the above-identified patent and that said Letters Patent is hereby corrected as shown below:

In claim 3, at line 31, replace the word 'armature' with the word 'curvature'.

In claim 17, at line 64, replace the word 'position' with the word 'portion'.

In claim 20, at line 42, replace the word 'fight' with the word 'right'.

Signed and Sealed this

Third Day of November, 1998

*Attest:*

Bruce Lehman

BRUCE LEHMAN

*Attesting Officer*

*Commissioner of Patents and Trademarks*